United States Patent [19]

Von Knorring

[11] 4,173,272

[45] Nov. 6, 1979

[54] PARKING CONTROL SYSTEM

[75] Inventor: Knut A. Von Knorring, Sodertalje, Sweden

[73] Assignee: AB Transporteknik, Stockholm, Sweden

[21] Appl. No.: 837,455

[22] Filed: Sep. 28, 1977

Related U.S. Application Data

[63] Continuation-in-part of Ser. No. 567,130, Apr. 11, 1975.

[51] Int. Cl.[2] ..... G07F 15/12

[52] U.S. Cl. ..... 194/9 T; 194/DIG. 23

[58] Field of Search ..... 194/DIG. 22, DIG. 23, 194/9 R, 9 T, DIG. 21

[56] References Cited

U.S. PATENT DOCUMENTS

| | | | |
|---|---|---|---|
| 2,712,125 | 6/1955 | Koch | 194/DIG. 23 |
| 2,936,057 | 5/1960 | Alimanestiano et al. | 194/DIG. 23 |

*Primary Examiner*—Stanley H. Tollberg

[57] ABSTRACT

A parking control system includes a central parking meter having coin slots and a binary electronic unit cooperating with a number of indicating members representative respectively of a number of parking spaces. The indicating members are adapted to be activated by the electronic unit depending upon the value of the coin inserted and are arranged to continuously indicate the remaining unexpended parking period for each parking space.

8 Claims, 3 Drawing Figures

PARKING CONTROL SYSTEM

RELATED APPLICATION

The present application is a continuation-in-part of Ser. No. 567,130, filed Apr. 11, 1975.

BACKGROUND OF THE INVENTION

The present invention relates to a parking control system including a parking meter with coin slots and a binary electronic unit cooperating with a number of indicating members.

Systems for providing a visual indication of accrued parking time and accumulated charges per parking space have been known heretofore. However, such systems make no provision for prepayment by the operator of the vehicle and thus do not lend themselves to central control over a number of parking spaces and to monitoring of such spaces in a manner whereby a single attendant is able to instantly ascertain which of such spaces is occupied by a vehicle beyond the authorized or prepaid time.

SUMMARY OF THE INVENTION

It is an object of the invention to effect a parking control system capable of operating without parking tickets and with a single parking centro-meter so as to permit central supervision and control of a large number of parking places.

A further object of the present invention is to provide a parking control system enabling a continuous control of the remaining paid parking time for each parking place connected to the system.

According to the present invention, there is provided a parking control system comprising at least one parking meter having a plurality of coin slots; a plurality of indicating members each arranged for one of a plurality of parking spaces, the indicating members comprising a number of visible signal means arranged to be initially activated in dependence of the magnitude of the parking charge paid for each of the parking places and arranged to be successively inactivated as the parking period for which payment has been made expires; and a binary electronic control unit operatively connected with said coin slots and with the indicating members for activating and inactivating same in accordance with the prepaid parking charge as represented by the coins inserted in one or more of the coin slots.

Other objects and advantages of the invention will become readily apparent from the following description of the invention.

BRIEF DESCRIPTION OF THE DRAWINGS

In order that the invention may be more fully comprehended, it will now be described, by way of example, with reference to the accompanying drawings in which.

DETAILED DESCRIPTION OF THE INVENTION

Figure 1:
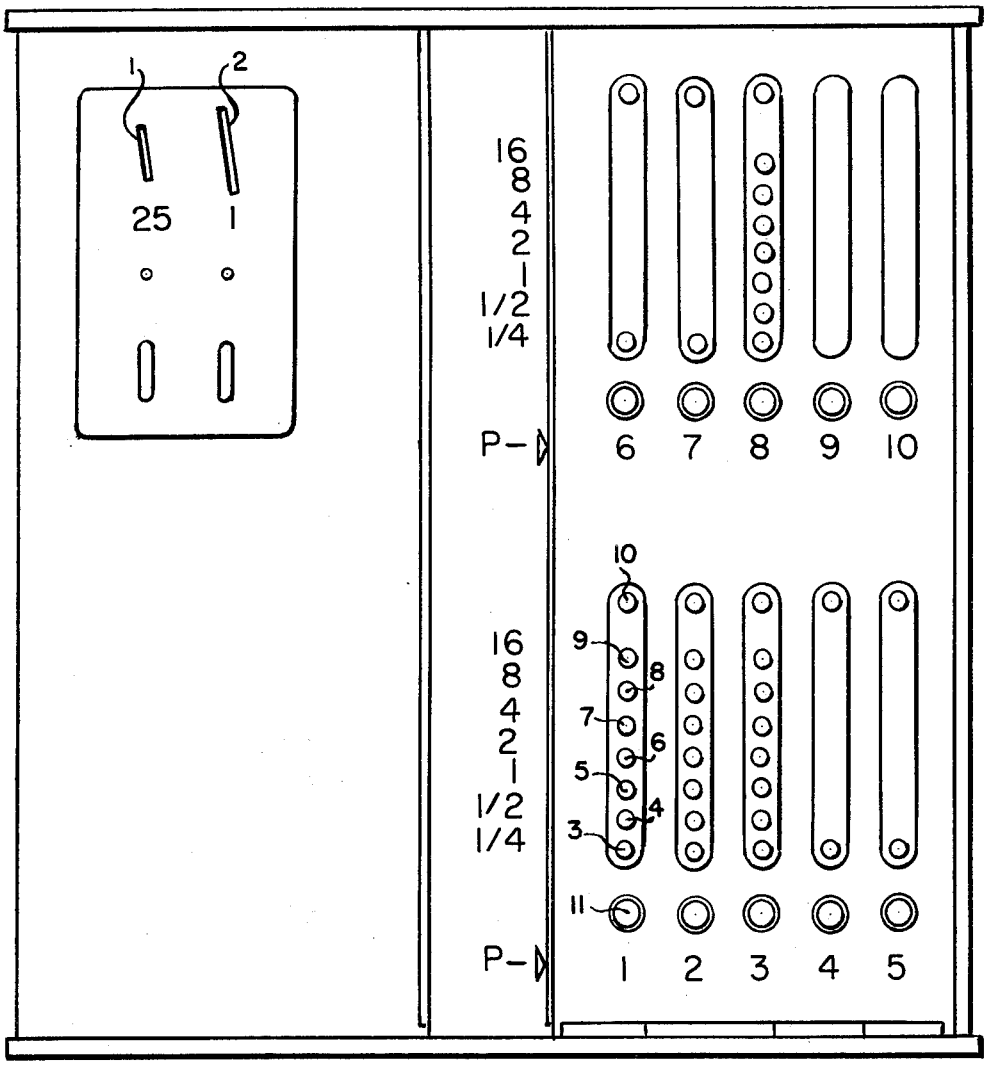
FIG. 1 is a diagrammatic front view of a parking meter embodying the features of the invention.

Referring to the drawings, there is shown a parking meter 1 provided with conventional coin slots 1, 2 for receiving coins of two different values and an electronic unit which, depending on the parking period prepaid by the coin deposit, initiates a series of indicating lamps 3, 4, 5, 6, 7, 8, 9, provided for each parking place. Each such parking place is individually identified such as by indicia 1–10 arranged horizontally in the drawing. Above each such individual parking place designation is a row of indicating lamps, the lowermost lamp 3 indicating, for example, that a parking period of 15 minutes has been paid for, the next lamp 4 in the row a parking period of 30 minutes, the subsequent lamp 5 a period of one hour, lamp 6 a period of two hours, lamp 7 a period of four hours, lamp 8 a period of eight hours and lamp 9 a period of 16 hours. Uppermost in each row of indicating lamps, and at a slightly greater distance from lamp 9, is yet another indicating lamp 10 which is arranged to be initiated a certain time after the parking period paid for has expired, for example, after 7.5 minutes. A parking place button 11 is desirably provided above or below the bank of lamps for each parking place and may be separately activated.

Figure 2:
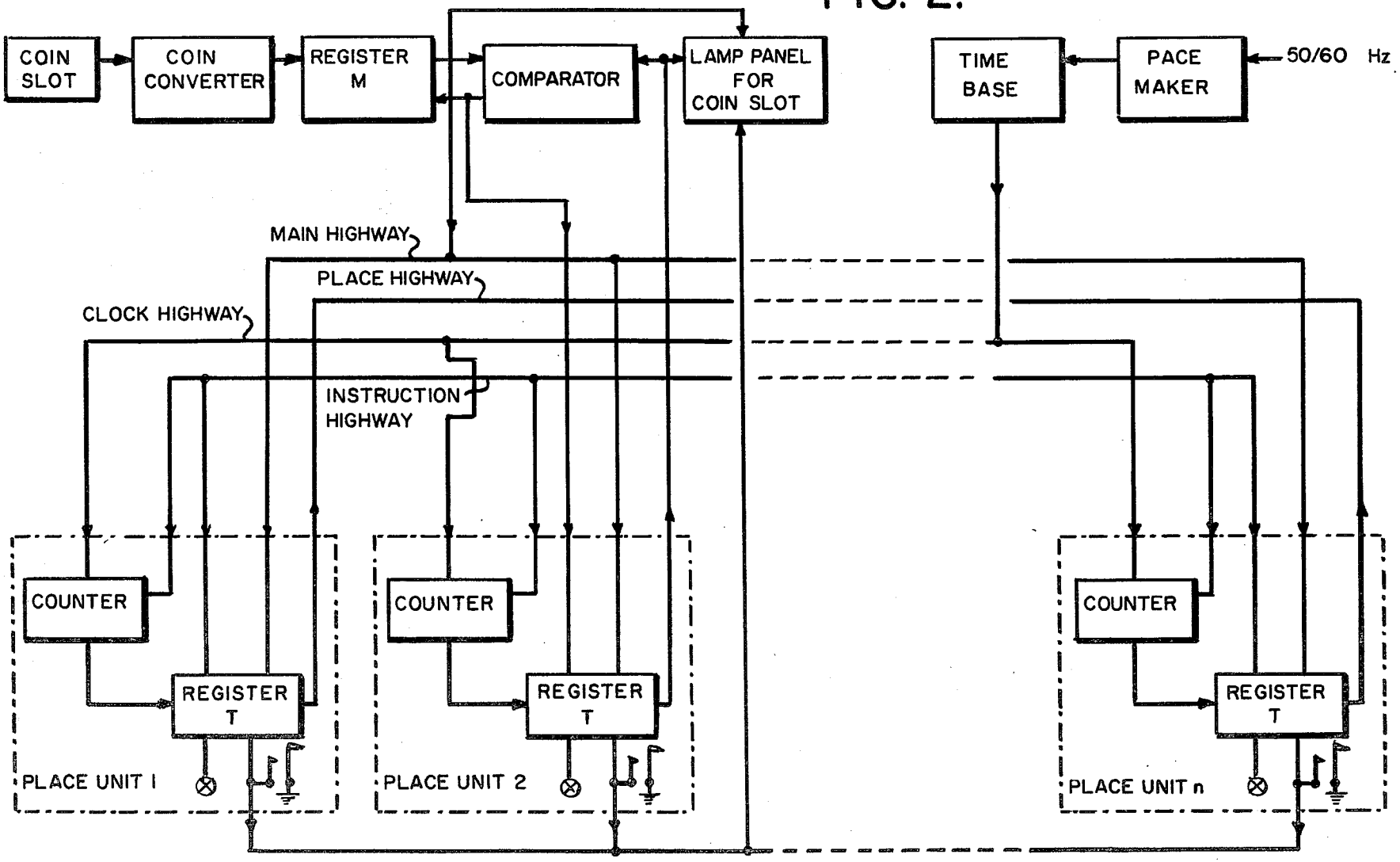
FIG. 2 is a schematic circuit diagram.

FIG. 2 is an operations chart for the digital integrated circuit electronic main unit and a parking place unit of the centro-meter.

The parking control system shown is intended to serve ten parking places, but naturally the invention is not limited to any specific number of parking places which may be more or less than ten.

The parking control system shown operates in the following manner:

The appropriate coin for the parking period to be prepaid is inserted in the coin slot, after which the button 11 for the selected parking place is activated. The number of indicating lamps corresponding to the fee paid will then light up. As the parking time runs out, the indicating lamps 3–9 will be sequentially extinguished and, after expiration of the prepaid parking period, i.e., 7.5 minutes thereafter in the case shown, the lamp 10 will light up, indicating that the parking period paid for has expired. The supervisory personnel can then easily determine if the vehicle is still in the parking place. Operation of the indicating lamps in accordance with the time schedule arranged is taken care of in convention manner by the binary electronic centro-meter system.

The centro-meter system of FIG. 2 is entirely electronic apart from the coin slots 1 and 2 which are mechanical. It is built up of digital integrated circuits from the TTL group, 74M series. In principle, the fully binary electronic control unit is constructed around two basic units: one main unit covers coin conversion, register M, comparator, coin slot indicator, time base unit and pacemaker. The other, the so-called parking place unit, is composed substantially of a counter and a register, register T. Conversion from coin value to digital pulses takes place in the main unit, the pulses then being distributed over a network of pulse conductors to the place units. The number of place units is the same as the number of parking places to be served by the system. The appearance of the lamp panel determines programming in the time base unit. The time base unit is controlled by a pacemaker which is in turn supplied at 50 Hz, or in some cases 60 Hz from the power supply. Down-counting is performed in the time base unit to provide a suitable number of pulses in relation to the charge rate to be used in the system. These pulses are sent out continuously on the clock highway (bus). The pulse from the coin insert is converted in the coin-conversion section either via a microswitch or a reading fork. The pulse is converted to a number of pulses which are also controlled by the rate of charges decided upon and the ratio between the values of the two coins which can be used in the system. In principle, the coins may be of any type and the coin-conversion part can be programmed in each case to adjust the ratio between the two coins used as well as the number of pulses which the lowest coin unit shall deliver in relation to the time base and charge rate. These pulses are then recorded in register M which in principle is a conventional binary counter. The coin insert indicator reads register M and lights the appropriate lamps. The binary information from register M also passes to the comparator and to the main highway. The main highway distributes the binary information to all place cards and waits there for the place card from which it receives an impulse to be registered. This is the first phase in the recording principle in the electronic centro-meter system.

The starting point for the second phase may differ. First of all, the proposed parking place may be quite clear, i.e., the place lamp is not illuminated. Secondly, there may be time marked for a place, in which case there are two other possibilities; either the time registered in register T is shorter than the new time registered in register M, or the time registered in register T is longer than that registered in register M. When a place button is pressed, the register T sends stored information out on the place highway. Binary information which may be recorded in register T enters the other side of the comparator and the comparator determines whether the time already registered was longer or shorter than the information registered in register M. If the time in register T was greater than the information registered in register M, nothing will happen at this stage. This is a purely protective function to prevent malicious interference wth a long parking time which has been paid for, for inserting a coin of low value. If the information in register T is less than that in register M, or none at all, the comparator will send a signal on the instruction highway which will write register M's information from the main highway down to register T. Register M is then zero filled and the information from the lamp indicator, the coin insert information, is taken over by register T as long as the place button is depressed. The signal on the instruction highway also starts the place unit counter which then counts the pulses coming from the time base unit on the clock highway. These pulses are divided by 15 in the counter, which means that the counter sends one pulse for every 15 pulses on the clock highway. These pulses are sent to register T which in turn counts down one binary step for each incoming pulse. When the information is written in to register T, the lamp is also illuminated which indicates that the parking place is occupied and paid for. When the place button is released, the coin insert panel is extinguished and the system is ready for the next customer.

When register T has received so many pulses that it has counted down to zero, indicating that the parking time paid for has expired, the place lamp will be extinguished. At the same time, the counter is zero filled and the clock highway no longer has any influence on the place until it is paid for again.

If one wishes to ascertain how long the parking place has been paid for, the place button should be pressed, whereupon a signal is emitted to the coin insert panel at the same time opening between the place out to the place highway which also leads to the coin insert panel and lighting up the number of lamps corresponding to the registration currently in register T. These lamps will remain illuminated as long as the place button is depressed and will be extinguished when it is released.

According to an alternative embodiment, for example, only one signal lamp may be used for each parking place, this either being caused to light up when the parking period has expired or being caused to remain illuminated during the period for which payment has been made. With this embodiment, there should preferably also be a function enabling a check to be made of the remaining parking time for the parking places connected. This might be through an indicating window, for example, in which the appropriate time becomes visible when a button for the purpose is depressed.

The parking period paid for should preferably also be visible through such an indicating window for a short time after the coin is inserted.

The system is designed to act as a collection of individual parking meters but at the same time as a ticket machine without tickets in that it is located centrally at the entrance or exit and that additional time cannot be bought. The present invention thus provides a simple parking system wherein the parking centrometer itself can be strategically placed within the parking area to be controlled, thus enabling rapid and simple supervision. The means proposed according to the invention is extremely reliable in operation since it has no movable mechanical parts.

Figure 3:
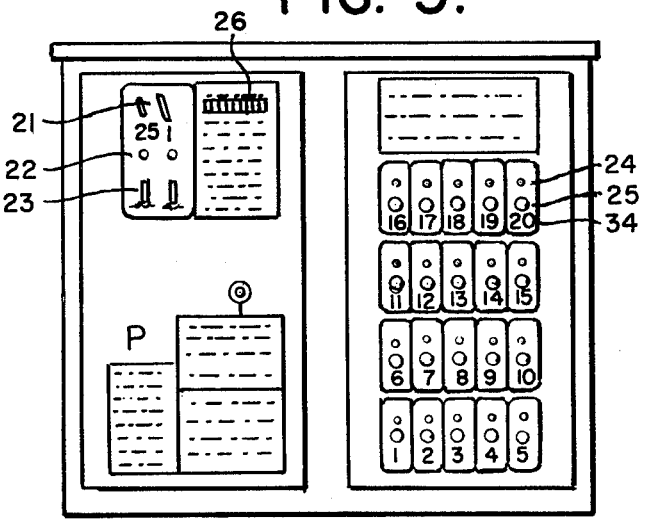
FIG. 3 is an illustration of a second embodiment of the invention.

A further embodiment of the invention is shown in FIG. 3 of the drawings. It will be seen from this figure that the parking meter has a coin slot 21, for three different sizes of coins, a return button 22 for faulty coins and a slot 23 for rejected coins. The coin slots are arranged to cooperate with an electronic unit, not shown (but which is conventional), which initiates an indicating lamp or parking place lamp 24 for each parking place G in accordance with the parking period paid for, this being indicated at the time of payment in a display field or indicating window 26. A place button 25 is provided for each parking place G or place lamp 24. The parking place numbers G are indicated on the parking meter by the numbers 21–40.

The arrangement shown in FIG. 3 functions as follows:

The parking meter is placed strategically in relation to the number of parking places to be monitored in order to provide the most convenient service. Each car parking place within the parking area is designated with a number and the corresponding place number G is depicted on the meter. When the motorist has parked his car, he goes to the meter and pays for the parking period desired. As the coins are inserted, the display field 26 indicates how much parking time has been purchased. The display field 26 may be arranged to flash when the maximum parking time has been paid for. When the desired fee has been paid, button 25 is pushed, after which no additional time can be purchased. The place lamp 24 now lights up and indicates that the fee for the parking place in question has been paid. The place lamp 24 is only extinguished when the parking time has run out. The place button 25 may be activated to check that the correct time has been recorded or to see how much time is left, the remaining parking time being then indicated on the display field or the indicating window 26.

The meter proposed by the invention may preferably have a flexible charge rate. It can, of course, be programmed for different rates on certain days of the week or for a certain portion of a 24-hour period, as well as for standard rates. The time of day during which payment must be made and the maximum parking period can also be varied. The free-parking time can also be by-passed so that parking time can be purchased for the next day as well.

Thus, it is apparent that, while the present invention has been shown in only one embodiment, numerous changes and modifications can still be made. The present disclosure should, therefore, be taken as illustrative only and not limiting of the invention.

What is claimed is:

1. A parking control system comprising at least one parking meter having a plurality of coin slots; a plurality of indicating members each arranged for one of a plurality of parking spaces, said indicating members comprising a number of visible signal means arranged to be initially activated in dependence of the magnitude of the parking charge paid for each said parking place and arranged to be successively inactivated as the parking period for which payment has been made expires; and a binary electronic control unit operatively connected with said coin slots and with said indicating members for activating and inactivating same in accordance with the prepaid parking charge as represented by the coins inserted in one or more of said coin slots.

2. The parking control system according to claim 1, wherein said visible signal means comprise visible lamps.

3. The parking control system according to claim 1, wherein said indicating members comprise a plurality of indicating lamps, said indicating lamps being arranged in a row one after the other and arranged to be sequentially deactivated after predetermined periods of time.

4. The parking control system according to claim 3, including a special indicating lamp arranged to be activated a certain predetermined time after expiration of the parking period for which payment has been made.

5. The parking control system according to claim 1, wherein a single additional signal means is provided for each parking space.

6. A parking control centro-meter system including a main unit, n-parking place units and lamp panels, wherein the main unit comprises a coin slot indicator, a converter for coin value conversion to digital impulses, an impulse register M, an impulse comparator and a time base unit controlled by a pacemaker wherein down-counting is performed in the time base unit to given suitable number of impulses in relation to the charge rate to be used in the system and the appearance of the lamp panel determines the programming of the time base unit.

7. A parking control centro-meter system according to claim 6 including a main unit, n-parking place units and lamp panels, wherein each said parking place unit comprises a counter and a register T.

8. The process of controlling parking with a binary electronic coin operated parking control centro-meter system which includes a main unit and n-parking place units cooperable with an illuminatable control panel which comprises:

converting coin value to digital impulse, recording said digital impulses in a binary counter, register M, passing the recorded information from register M to a comparator, distributing the information to a selected parking place unit register T, and comparing impulses from register M and register T and lighting selected control lights when the information in register T is less than the information in register M.

* * * * *